United States Patent [19]

Oats

[11] Patent Number: 4,926,513

[45] Date of Patent: May 22, 1990

[54] APPARATUS FOR CHANGING DISPOSABLE BEDDING ON A MATTRESS

[75] Inventor: Edwin O. Oats, Dallas, Tex.

[73] Assignee: Roll-in-Sheet Inc., Dallas, Tex.

[21] Appl. No.: 372,326

[22] Filed: Jun. 28, 1989

Related U.S. Application Data

[63] Continuation-in-part of Ser. No. 279,973, Dec. 5, 1988, abandoned.

[51] Int. Cl.[5] ..... A47C 21/00

[52] U.S. Cl. ..... 5/488

[58] Field of Search ..... 5/488, 482, 508, 487; 297/221, 222; 312/37, 38

[56] References Cited

U.S. PATENT DOCUMENTS 3,641,600 2/1972 Oats ..... 5/488

4,025,973 5/1977 Walbrecht ..... 5/488

*Primary Examiner*—Alexander Grosz

*Attorney, Agent, or Firm*—J. Gibson Semmes

[57] ABSTRACT

In storage and utilization of disposable bedding materials as for example for institutional usage, non-woven bedding materials dispensably secured to a portable bed, and including tensioning therefor, whereby the two or more bedding materials such as sheets are held in superposed and stretched relation to the mattress of a bed, the system to include means for longitudinally shifting used portions of bedding materials, for cutting same, while simultaneously replacing same in bedding relation to a bed mattress. Sheets may either be pulled, hand-cranked or motorized on a bed.

2 Claims, 4 Drawing Sheets

APPARATUS FOR CHANGING DISPOSABLE BEDDING ON A MATTRESS

REFERENCE TO RELATED APPLICATIONS:

This is a Continuation-in-Part of patent application Ser. No. 07/279,973, filed Dec. 5, 1988 now abandoned, entitled METHOD AND APPARATUS FOR DISPOSABLE STORAGE AND UTILIZATION OF NON-WOVEN DISPOSABLE AND/OR REUSEABLE BEDDING AND DRAPERY MATERIALS.

BACKGROUND ON THE INVENTION

This invention is closely related to U.S. Pat. No. 3,641,600 dated Feb. 15, 1972, wherein the present inventor has previously secured protection It is also pertinent to U.S. Pat. No. 4,025,973 issued to Ernest Walbrecht on May 31, 1977. The invention is distinctive thereover in the following respects. Heretofore, non-woven fiber soft goods of high quality were not readily available; thus presently calling for new technology in storage and dispensing. The storage capacity and delivery of the disposable, folded, non-woven product is highlighted by the unique adaptor storage, dispensing and cutting elements. The dispensing package may include other associated disposable elements, for example: pillowcase, towel and washcloth. It is especially adapted to storage and dispensing of folded, non-woven fiber products such as superposed sheets. Conventional woven separated materials can also be used, utilizing hooks and loops tape fasteners (Velcro t.m.) to attach elements end to end and can be laundered and replaced in the dispenser.

SUMMARY OF INVENTION

The ROLL-A-SHEET (t.m.) invention utilizes a bed, stretcher, or gurney storage carton or cartridge system which is adapted to feed and retrieve a substantially continuous supply of bedding cover which is folded to some fractional width of the bed, that is ½, ⅓, etc., thus allowing a change of bedding covers while the patient remains on the bed. The carton or cartridge is disposed intermediately at ends of a bed such as an institutional, power activated, articulable bed unit. Dispensing control rollers and mounting bracketry are preferably universally adjustable to fit any number of applications. To allow articulation of the bed, the bedding tension is controlled by means of a spring and/or gravity controlled moving carton or cartridge tray. The basic concept of the invention is equally adapted to the intermittent dispensing of other materials such as drapes, shades and the like. In view of this fact the horizontal disposition and association with the support relative to the ground as indicated in the attached drawings is not essential. Vertical or other alternate angular disposition, relative to the horizontal and attachment to the headboard, foot, or an adjacent wall or stand is thus quite feasible as will be apparent hereinafter.

DESCRIPTION OF PREFERRED EMBODIMENTS

Figure 1:
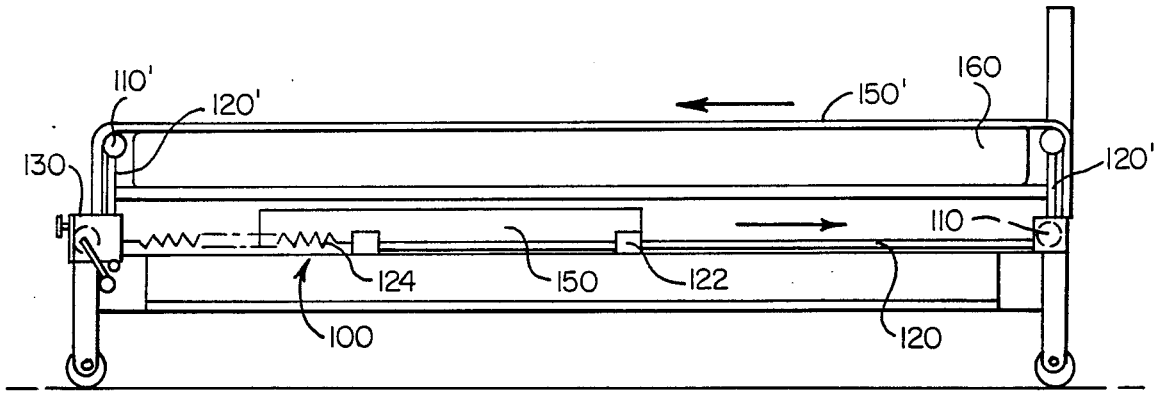
FIG. 1 is a view in side elevation of the invention as applied to a bed frame and mattress combination.
Figure 1A:
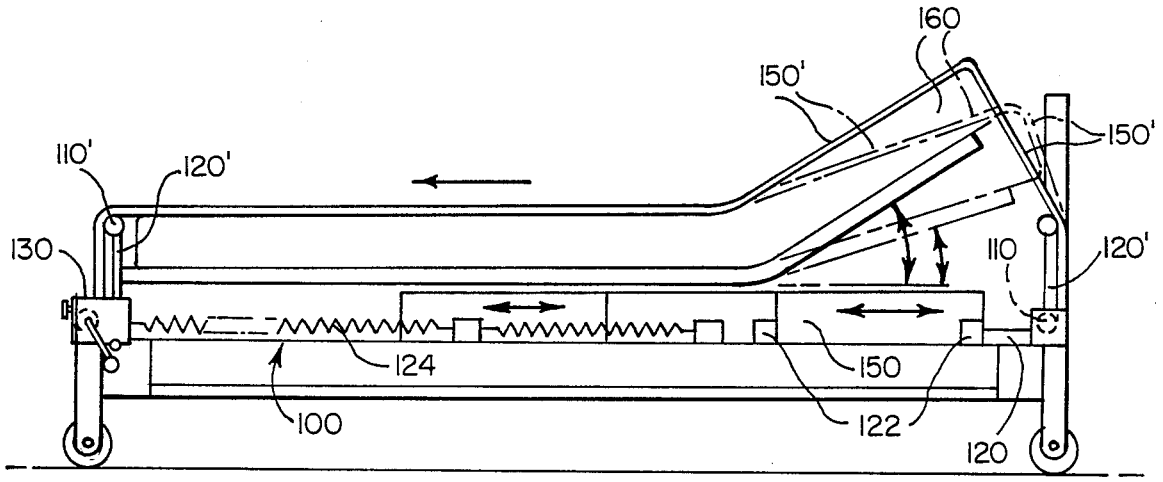
FIG. 1A is a view in side elevation showing the tray excursion during articulation of the bed, with intermediate position shown in phantom.
Figure 2:
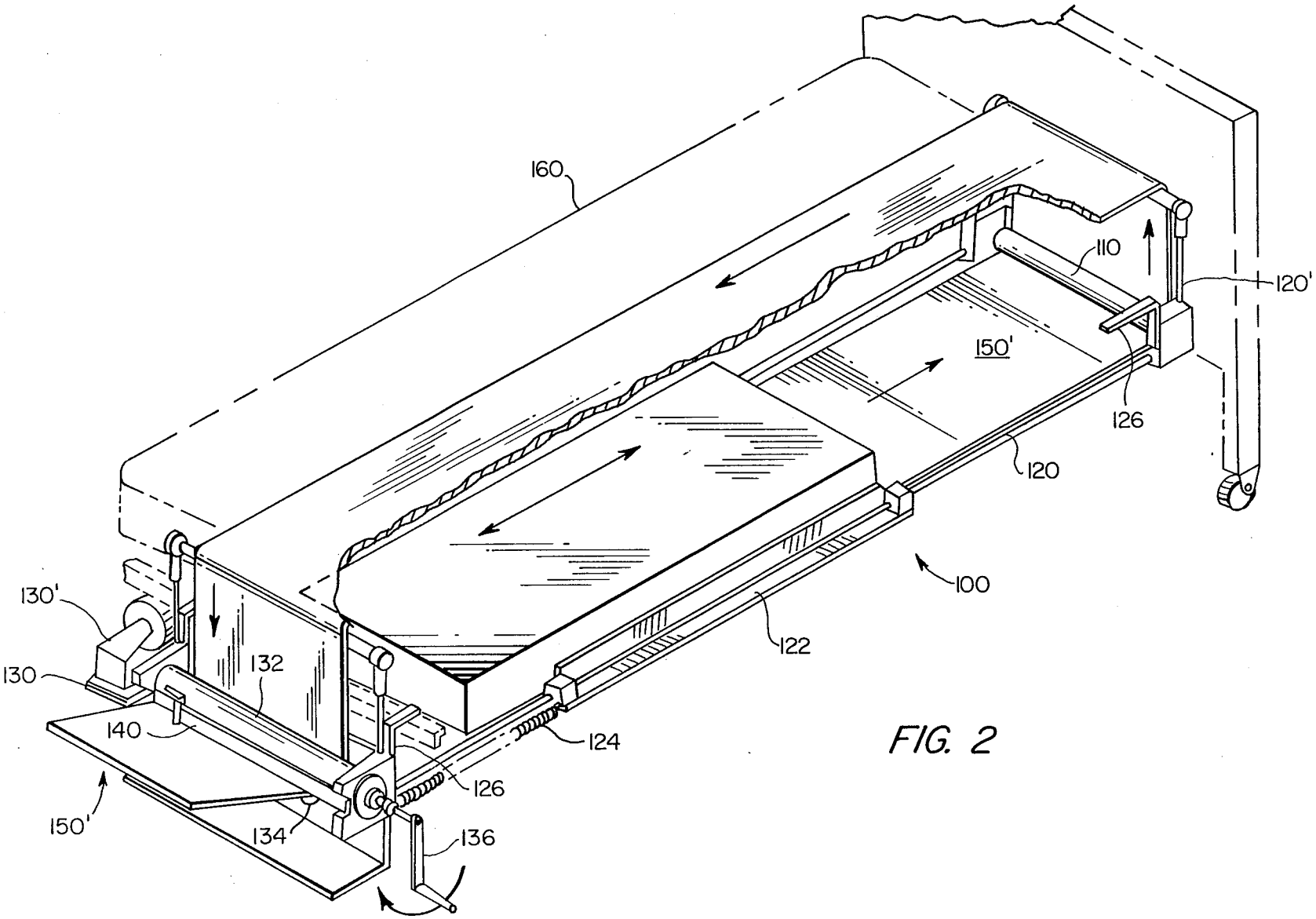
FIG. 2 is a perspective of the system apparatus as adapted to a portable bed.
Figure 3:
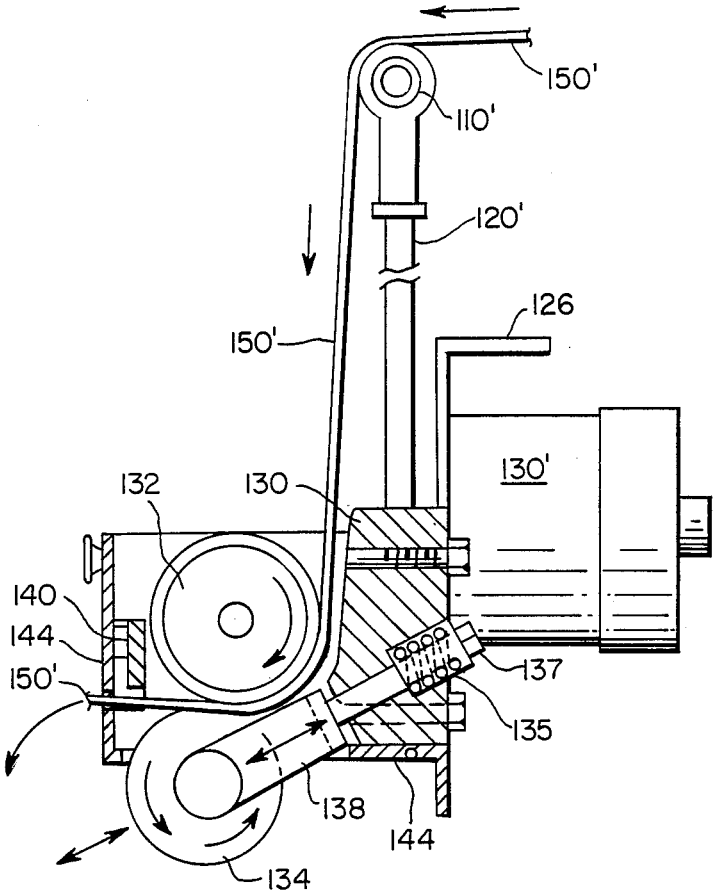
FIG. 3 is a partial section in side elevation of the foot end of the apparatus layout.

Referring to the drawings, the rollable sheet bedding system includes in combination, the main frame 100, as mounted upon a conventional bed frame See FIG. 1 The four cornered main frame consists of interconnected guide rollers 110 and 110', the latter being vertically adjustable relative to the former by means of adjuster 120'. At the bottom, the roller assembly 110 at the headboard is connected to the actuating assembly 130, at the footboard by means of the guide rails 120 which extend from to head to foot and upon which a boxed or cartridge sheet tray 122 rides under tension by springs 124 and or gravity. See FIG. 2 The tray 122 is provided with a sheet clamping means, not shown, the same being coactively set with respect to the tray and overall tension assembly 120-122-124. This allows the tray to move along the guide rails 120, see FIG. 1A, thus providing relatively constant tension to the bedding cover as the bed is articulated. The tray bumper 126, FIG. 2, is fixed to the actuating assembly 130, providing a limit to the contracted excursion of the tray 122. The actuating assembly 130 is located at the foot of the bed as shown in FIG. 2 A motarized drive unit 130' which drives roller 132 through the use of right angle gears, not shown, is set upon the main frame 100 to actuate roller 132 against the pressure applied to idler roller 134 see FIG. 3, through the sliding arm 138, by spring 135, whose pressure can be adjusted by turning nut 137. Alternately the motorized drive unit 130' could be set axially to the rollers and could drive roller 132 through spur gears, belts and pulley, chains and sprockets not shown, or a hand crank 136 could drive 132 directly. The combination of drive roller 132 and idler roller 134 could be used to pull the sheet components 150' over the mattress 160, thus advancing a set of clean sheets into position over the mattress as a used sheet set is removed. A suitable used sheet cut-off bar 140 is offset from the rollers 132 and 134 to cut off the used portion of 150' and a hinged cover 144 is applied to protect the user. FIGS. 2 and 3.

Figure 4:
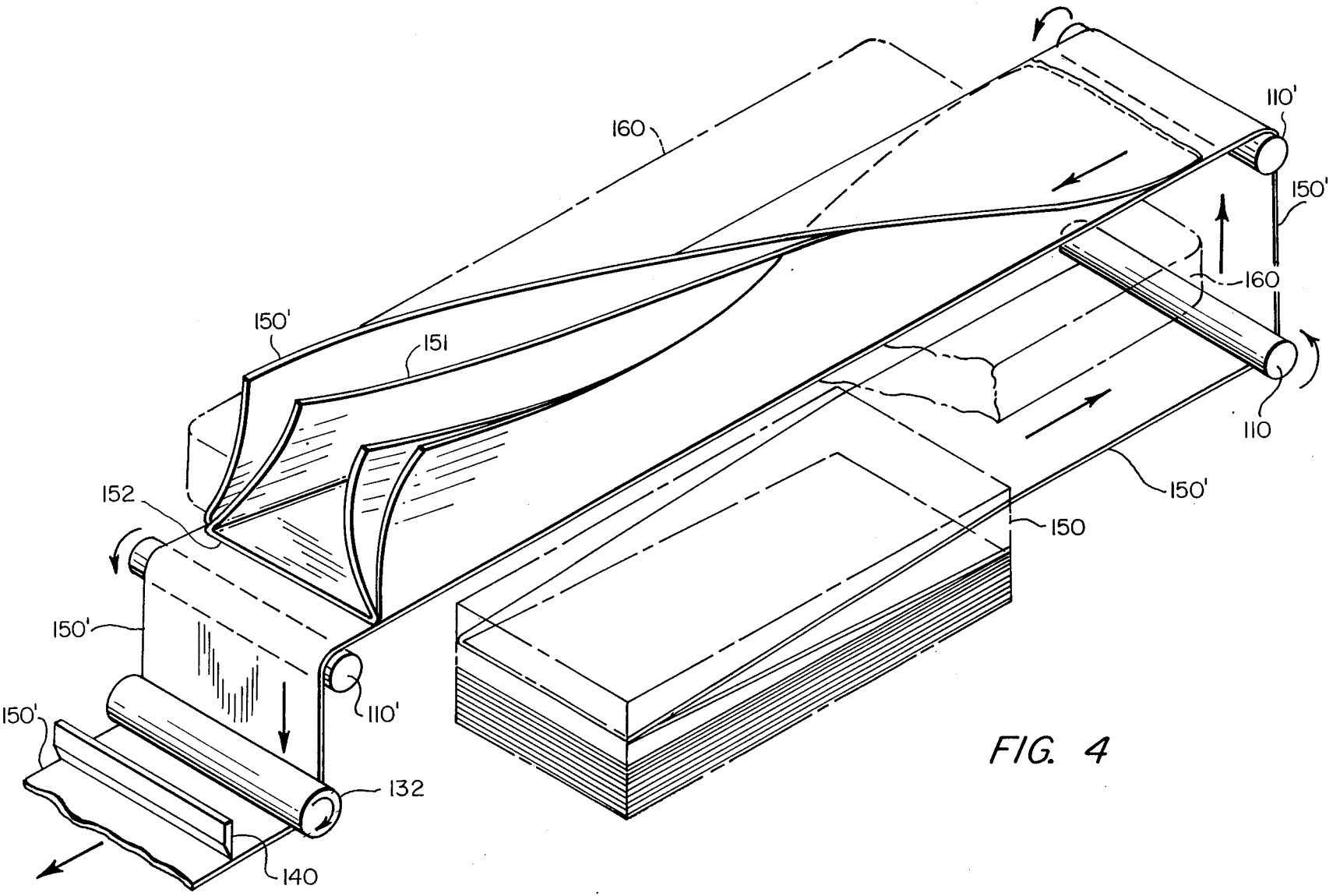
FIG. 4 is a perspective of the path of the bedding without detail of the mechanism.

The sheet components of 150' could include a top sheet 151, see FIG. 4, the same being of discontinuous sections, each secured transversely at the foot end 152 by adhesive means, to the lower sheet 150', said lower sheet comprising a continous blank. Longitudinal spacer segments in the lower sheet 150' are set between the conventional bed segments to provide a means of adapting the sheets being used to the mattress 160. The top and lower sheets are folded lengthwise on each, side. The top sheet may or may not have greater width than the lower sheet and be folded at its sides inside the lower sheet to substantially the same width as the lower sheet. The carton 150 contains the successive top and lower sheets in lapped and folded relationship, whereby they may be dispensed under tension by the apparatus described. These sheets or drapes may be made of non-disposable woven materials which are serially connected by hooks and loops tape fasteners (Velcro, T.M,) or other fasteners end to end.

In making the bed, top sheet sides and bottom sheet sides are folded outwardly and downwardly on the mattress 160 and the bed is ready for further making in the usual manner by the addition of a blanket and/or other covers. Noteworthy in the construction is the disposition of working elements to avoid interference with normal bed covers and/or pillows.

In securing the superposed sheets 150' and 151 for utility, they are passed over the rollers 110-110' to the actuating assembly 130 and under roller 132, said actuating assembly ideally holding the sheets in compression contact with the idler roller 134, against indisposition while in use. Hereafter relatively constant tension is maintained on the sheets 150' by springs 124 and or gravity acting upon the tray assembly 122.

After the sheet has been fed over the rollers 110-100' and fed through the actuator 130, the free end of the sheet is adapted to pass under the shear cut-off 140; whereby upon forced passage of the entire complement of top and bottom sheets, it may be cut and discarded, substantially simultaneously as a new and fresh combination is brought into register in contiguous relation to the top surface of the mattress 160. Appropriately, markings on the disposable sheets 150'-151 could define registry position relative to the shear 140. Again, in lieu of a shear, the sheet may be scored at utility intervals sufficient in length to accommodate one bed making at a time; e.g.: spaced relative to the top sheet segments.

Whereas the invention has been shown in its simplest form, it is obvious that various means of securing and passing the rolled sheet into and out of registry with the supporting mattress may be adapted without departing from the spirit of the invention in which I claim:

1. The combination, with a bed having a mattress, and disposable bedding sheets in tension contact with the top surface of a mattress, comprising:

A. a bedding storage carton for storage of folded increments of bedding sheets that are folded to some fractional width of the mattress, commensurate with the width of the storage carton;

B. means supported by the bed to control tension relationship of the storage carton means, by tension springs and to rollably guide multiple increments of bedding sheets;

C. said bedding sheets comprising at spaced intervals, a topmost sheet and a lowermost sheet, said sheets being of substantially the same width, said sheets also having longitudinal edges folded upon themselves;

D. means mounted on the bed, opposite the means supported by the bed to control tension and to advance portions of multiple increments of said bedding into and out of registry with the mattress of said bed; and E. means to sever used portions of the disposable bedding.

2. The combination of claim 1, wherein the topmost bedding sheet is size-for-size adapted in length to the overall length of the bed, per se, said topmost sheet being of greater width than the lowermost sheet, is folded again upon itself so that its edges are at substantially the same location as the edges of the folded lowermost sheet, whereupon said bed is made, said edges will depend along the sides of the mattress.

* * * * *